US010065898B1

(12) United States Patent
Luna

(10) Patent No.: US 10,065,898 B1
(45) Date of Patent: Sep. 4, 2018

(54) BULK PUMPABLE GRANULATED EXPLOSIVE MIX

(71) Applicant: EXSA S.A., Lima (PE)

(72) Inventor: Karl Maslo Luna, Lima (PE)

(73) Assignee: EXSA S.A., Lima (PE)

( * ) Notice: Subject to any disclaimer, the term of this patent is extended or adjusted under 35 U.S.C. 154(b) by 0 days.

(21) Appl. No.: 15/814,598

(22) Filed: Nov. 16, 2017

(30) Foreign Application Priority Data

Sep. 21, 2017 (PE) ..... 1580-2017/DIN

(51) Int. Cl.

| | |
|---|---|
| ***C06B 31/28*** | (2006.01) |
| *C06B 31/00* | (2006.01) |
| *D03D 23/00* | (2006.01) |
| *D03D 43/00* | (2006.01) |

(52) U.S. Cl.
CPC ..... *C06B 31/28* (2013.01)

(58) Field of Classification Search
USPC ..... 149/46, 45, 109.2, 109.4
See application file for complete search history.

(56) References Cited

U.S. PATENT DOCUMENTS

| | | | | |
|---|---|---|---|---|
| 4,401,490 | A | 8/1983 | Alexander et al. | |
| 4,434,017 | A | 2/1984 | Smith et al. | |
| 4,456,492 | A | 6/1984 | Alexander et al. | |
| 4,822,433 | A | 4/1989 | Cooper et al. | |
| 5,500,062 | A | 3/1996 | Chattopadhyay | |
| 2003/0140995 | A1* | 7/2003 | O'Hara | C06B 23/004 149/46 |
| 2015/0033969 | A1* | 2/2015 | Gore | C06B 21/0008 102/313 |

FOREIGN PATENT DOCUMENTS

CN 105753614 A * 7/2016

* cited by examiner

*Primary Examiner* — James E McDonough
(74) *Attorney, Agent, or Firm* — Polsinelli PC

(57) ABSTRACT

The disclosure is directed to pumpable explosive compositions that include a matrix emulsion, which has i) technical or fertilizer grade ammonium nitrate in a ratio between 60% and 70%; (ii) sodium nitrate from 1% to 20%; iii) urea from 0.1% to 8%; iv) thiourea from 0.1% to 2%, v) water from 5% to 20%, vi) acetic acid or sulfamic acid from 0.1% to 2%; vii) surfactants of non-ionic or polymeric nature from 0.5 to 3%; and viii) a hydrocarbon such as petroleum or a paraffinic or naphthenic based mineral oil, and where a second component of composition are technical and/or fertilizer grade ammonium nitrate prills in a ratio from 5% to 50%.

11 Claims, No Drawings

BULK PUMPABLE GRANULATED EXPLOSIVE MIX

CROSS REFERENCE TO RELATE APPLICATION

This application claims priority to Peruvian Application No. 1580-2017/DIN, filed on Sep. 21, 2017, the entire contents of which is incorporated herein by reference.

SCOPE OF THE EMBODIMENTS OF THE PRESENT INVENTION

The embodiments of the present invention relate to explosive materials for use in mines by pumping equipment in underground mining.

SUMMARY OF THE EMBODIMENTS OF THE PRESENT INVENTION

The embodiments of the present invention are directed to to pumpable explosive compositions that comprise a) a matrix emulsion, which comprises i) technical or fertilizer grade ammonium nitrate in a ratio between 60% and 75%; (ii) sodium nitrate from 1% to 20%; iii) urea from 0.1% to 8%; iv) thiourea from 0.1% to 2%, v) water from 5% to 20%, vi) acetic acid or sulfamic acid from 0.1% to 2%; vii) surfactants of non-ionic or polymeric nature from 0.5 to 3%; and viii) a hydrocarbon which may be petroleum or a paraffinic or naphthenic based mineral oil from 4% to 10%, and where the second component of composition b) are technical and/or fertilizer grade ammonium nitrate prills with a density from 0.85 g/cm3 to 0.99 g/cm3. The explosive mix includes matrix emulsion from 50% to 95% and technical and/or fertilizer grade ammonium nitrate prills (granules) from 5% to 50%.

BACKGROUND OF THE EMBODIMENTS OF THE PRESENT INVENTION

International patents relating to systems for explosive compositions are known in the prior art. This is the case for U.S. Pat. No. 5,500,062 made for an explosive emulsion. Such invention relates a mixed surfactant system for use in explosives in emulsion which provides stability for the emulsion as it is a surfactant and a co-surfactant, wherein each of them contains hydrocarbon chain groups. The first surfactant has groups with tail chains significantly longer than the co-surfactant and wherein the surfactants are based on an alkenyl succinic anhydride with a beta interaction parameter less than zero.

Moreover, U.S. Pat. No. 4,456,492 discloses a molten state explosive composition that includes, as its first component, a molten mass which can be poured, pumped or flowed at a temperature in a ratio from −10° C. to +90° C. and comprising at least one oxygen-releasing salt, for example, ammonium nitrate, and at least one mass-soluble combustible material, e.g. urea, and an ammonium nitrate-accepted granules as its second component. The explosive composition offers the advantage of using relatively inexpensive fuel as secondary fuel in an explosive composition, which is in molten state without loss of sensitivity to the detonation of the composition during storage. The explosive compositions also show appropriate sensitivity retention to detonation under conditions of static pressure applied in deep explosive wells.

Likewise, U.S. Pat. No. 4,401,490 refers to a molten explosive composition, i.e., the composition is in fluid state and comprises at least one oxygen-releasing salt, like the ammonium nitrate; at least one combustible material soluble in melting, such as, for example, urea; and at least one naphthalenesulfonate derivative selected from formaldehyde condensates and naphthalenesulfonic acids and their alkaline and alkaline earth metal salts, e.g. disodium methylene-bis (naphthalene-beta-sulphonic) and wherein the explosive compositions show a better sensitivity to detonation in small diameter explosive wells.

In addition, U.S. Pat. No. 4,434,017 relates an explosive composition and its preparation, wherein the explosive compositions do not contain water and comprise an oxidizing salt, a combustible material miscible with the salt in the liquid state and further contains gaseous bubbles.

Furthermore, U.S. Pat. No. 4,822,433 describes an explosive composition in emulsion stage, wherein it contains an oxygen supplying component in the discontinuous phase and, in the continuous phase, it is constituted by an organic medium, wherein the oxygen supplying component and the organic medium are capable of forming an emulsion which in the absence of a supplementary adjuvant shows an average conductivity at 60° C. which is not greater than 60,000 picomhos/meter due to the presence of a modifier.

In addition, granulated explosive mixtures with anfo grade ammonium nitrate with a density ranging from 0.65 g/cm3 to 0.80 g/cm3 are known and packed in plastic sleeves or in bags of diameters greater than 2½ inches (65 mm) and pumpable for diameters greater than 3" (75 mm). However, these mixtures present the technical problem of not being sensitive to a 1"×8" (25.4 mm×203.2 mm) Emulsion or Dynamite cartridge but to a ⅓ pound (0.15 kg) booster for its initiation as column load.

Given all that, it is evident that the unmet need for explosive compositions susceptible of being pumped through pumping equipment for underground mining still exists in the state of the art, wherein the composition presents an improved stability in its handling time, as well as the need for compositions with improved explosion energy and increased gas volumes allowing improved fragmentation of the rock material.

DETAILED DESCRIPTION OF THE EMBODIMENTS OF THE PRESENT INVENTION

The embodiments of the present invention relate to the technical problem of pumpable explosive emulsions, which produce deficient detonation energies, therefore less rock fragmentation. The proposed solution in this embodiment is to provide a granular explosive mixture with higher energy and gas volume based on a emulsion containing ammonium nitrate between 60 and 75% on weight together with high density ammonium nitrate granules or prills with a density of 0.85 g/cm3 to 0.99 g/cm3 in a proportion from 5 to 50% on weight, sensitized with 0.1% to 3% of siliceous (glass) or plastic microspheres based on copolymers of isobutane and isopentane and a solution of sodium nitrite which gasifies the explosive mixture during its application.

The pumpable explosive composition according to the embodiments of the present invention includes an explosive mixture of matrix emulsion and high density technical and/or fertilizer grade ammonium nitrate prills. The matrix emulsion contains in its composition 60% to 75% technical or fertilizer grade ammonium nitrate, 1% to 20% sodium nitrate, 0.1% to 8% urea as fuel, 0.1% to 2% thiourea, 5% to 20% water, 0.1% to 2% acetic acid or sulfamic acid, 0.5% to 3% surfactants of a nonionic or polymeric nature and 4% to 10% of a hydrocarbon which may be diesel oil and/or biodiesel and/or mineral oil of paraffinic and/or naphthenic base. The pumpable explosive mixture is characterized because it is a mixture of the matrix emulsion with 5% to 50% technical and/or fertilizer grade ammonium nitrate with a density from 0.85 g/m3 to 0.99 g/cm3 which increases the energy of the explosive mixture.

The pumpable explosive mixture is sensitized with 0.1% to 3% of plastic or silica (glass) microspheres or by chemical gasification with a solution of sodium nitrite and is applied in underground mining with a pumpable unit in drills of 32 mm to 65 mm. The pumpable explosive mixture of the embodiment is initiated with a 1"×8" (25.4 mm×203.2 mm) dynamite or emulsion cartridge.

Furthermore, the embodiments of the present invention are targeted to explosive compositions or also referred to as explosive mixtures that are susceptible to bulk pumping by pumping equipment in underground mining, wherein the compositions comprise a) a matrix emulsion in the proportion 50% to 95% and b) 5% to 50% high density ammonium nitrate prills (granules).

Specifically, the embodiments of the present invention is related to pumpable explosive compositions characterized as they comprise An oxidizing phase, which comprises:

i) Technical or fertilizer grade ammonium nitrate in a proportion of 60% to 80% on weight with respect to the total weight of the oxidizing solution;

ii) Sodium nitrate from 1% to 20% on weight with respect to the total weight of the oxidizing solution;

iii) Urea from 0.1% to 8% on weight with respect to the total weight of the oxidizing solution;

iv) Thiourea from 0.1% to 2% on weight with respect to the total weight of the oxidizing solution;

v) water from 5% to 20% on weight relative to the total weight of the oxidizing solution;

vi) acetic acid or sulfamic acid from 0.1 to 2% on weight with respect to the total weight of the oxidizing solution;

A combustible phase which comprises:

vii) Surfactants of polymeric nature from 1% to 10-35% on weight relative to the total weight of the combustible solution and comprise Polyisobuten succinic anhydride (PIBSA);

viii) Nonionic surfactants from 1% to 35% on weight with respect to the total weight of the combustible solution;

ix) A hydrocarbon which may be petroleum, biodiesel or mixtures thereof from 1% to 80% on weight with respect to the total weight of the combustible solution;

x) A mineral oil of paraffinic or naphthenic nature from 1% to 70% wherein the proportion of the oxidizing solution is 90% to 95% and the combustible solution is 5% to 10% to form the matrix emulsion; and b) technical or fertilizer grade ammonium nitrate prills (granules) in a ratio from 5% to 50% on weight relative to the total weight of the total mixture.

For the compounds of the emulsion, in point (i) the ammonium nitrate may be of technical or fertilizer grade which indicates that ammonium nitrate with standard physicochemical characteristics can be used; for point (ii) sodium nitrate is in the form of technical grade white crystals; in point (iii) urea as granular or pearly grade crystalline fuel; at point (iv) the thiourea should be technical grade and the water involved in the matrix of the mixture of this invention may be potable, deionized, demineralized and distilled, among others.

At point (vii) of the matrix of the explosive composition of this invention, surfactants of nonionic nature may be selected from the group comprising of Sorbitan Monoleate (SMO) and a surfactant of polymeric nature which may also be part of an embodiment, which is selected from the group comprising Polyisobuten succinic anhydride (PIBSA), polyisobuten lactate anhydride and mixtures thereof. In a preferred embodiment of the invention, the surfactants for the matrix of the pumpable explosive composition of an embodiment are a mixture of PIBSA and SMO in a proportion of 10% to 90% of PIBSA with respect to SMO.

At point (viii) the hydrocarbons which may participate in the matrix of the pumpable explosive composition or mixture according to an embodiment may be light, heavy petroleum oils e.g. light petroleum oils having API grade higher than 31.1 and medium or medium crude with API grades between 29.9 and 22. Additionally, according to an embodiment, the hydrocarbon as component viii) may be selected from diesel oil, biodiesel, mineral oil or mixtures thereof.

In the case of paraffin-based mineral oil, the matrix of the pumpable explosive mixture or combination may have paraffinic oil, liquid petrolatum, heavy liquid petrolatum, white mineral oil, heavy mineral oil, petroleum oil, paraffin base, liquid paraffin, paraffin, liquid petroleum jelly, etc., where the physical properties of these mineral oils are: a boiling point 260° C. to 360° C. with a specific gravity of 0.845 to 1, oily liquid without color or odor. Generally, these mineral oils are a mixture of paraffinic hydrocarbons produced by the distillation of petroleum and have a general formula CxHy.

In the case of naphthenic-based mineral oil having a density of 0.80 g/cm3 to 0.90 g/cm3 and a viscosity of 50 cP to 1000 cP, the matrix of the pumpable explosive mixture or combination of the embodiments may have mineral oil.

For the case of component b) of the explosive mixture or composition of an embodiment, it is important to mention that the term "prills" means small aggregates, granules or globules from a material, which, in general, corresponds to dry spheres formed by a liquid molten, as understood by a person of ordinary skill in the explosives art.

The following example shows what has been done in an embodiment of the present invention,

Example 1 a. The oxidizing phase is prepared in a tank provided with a heating and a stirring system. 72.46% on weight of ammonium nitrate, 6.05% on weight of sodium nitrate, 1.00% on weight of thiourea and 17.59% on weight of water, 2.05% on weight of Urea and 0.85% on weight of sulfamic acid are dissolved at a temperature between 80° C. and 90° C.

b. For the combustible phase, a mixture of 20.50% on weight of surfactants on PIBSA, 7.40% on weight of Sorbitan Monooleate (SMO), 18.70% on weight of mineral oil of naphthenic nature and 53.4% on weight of biodiesel oil are melted and homogenized at 35° C. to 50° C. in another tank which is also provided with a heating system and a stirring system.

c. In the preparation of the emulsion, the oxidizing phase (a) and combustible phase (b) are introduced in the ratio of 94% oxidizing phase and 6% combustible phase in shear emulsifying tank of high speed at 1250 rpm, where the matrix emulsion is formed at a temperature between 75° C. and 85° C. with a density of 1.38 g/cm3 and a viscosity of 20,000 cP.

d. The obtained emulsion go through a mixer operating at 100 rpm, where 69.0% matrix emulsion is introduced along with 1.5% on weight of plastic microsphere and 29.5% on weight of fertilizer grade granular ammonium nitrate of density 0.85 g/cm3 at 0.99 g/cm3. The product obtained is pumped to a 30 ton (30,000 kg) silo at 75 ton (75,000 kg) capacity for storage.

e. When commercialized the granular explosive mixture is in bulk and applied in underground mining with a pumpable unit of pneumatic of electric, electro-pneumatic or hydraulic initiation. The density is regulated in situ as a function of the hardness of the rock by the addition of 0.5 parts on weight of gasifying agent of sodium nitrite that allows to obtain an explosive mixture having a density in the range of 0.80 g/cm3 to 1.25 g/cm3.

TABLE 1

| Formula 1 | |
|---|---|
| MATRIX EMULSION | % |
| AMMONIUM NITRATE | 68.11 |
| SODIUM NITRATE | 5.69 |
| THIOUREA | 0.94 |
| WATER | 16.53 |
| UREA | 1.93 |
| SULFAMIC ACID | 0.80 |
| PIBSA EMULSIFIERS | 1.23 |
| SORBITAN MONOOLEATE (SMO) | 0.45 |
| NAPHTHENIC OIL | 1.12 |
| BIODIESEL PETROLEUM | 3.20 |
| GRANULATED EXPLOSIVE MIXTURE RATIO | |
| MATRIX EMULSION | 69.00 |
| GRANULATED AMMONIUM NITRATE WITH FERTILIZER GRADE | 29.00 |
| PLASTIC MICROSPHERES | 1.5 |
| SODIUM NITRATE | 0.5 |
| RESULTS | |
| Density of the explosive mixture ($cm^3$) | 1.14 |
| Sensitive to the Detonator No 8 | NO |
| Sensitive to a bait of Dynamite, Emulsion and Booster HDP3 (150 g) | YES |
| Speed of detonation (m/s) | 5515 |
| Critical detonation diameter (Ø) | 32 mm |
| Lifetime (months) | 3 |
| Breaking power (mm) | 75 |
| Gas volume (L/kg) | 1280 |
| Energy (kcal/kg) | 805 |

TABLE 2

| TECHNICAL CHARACTERISTICS | PUMPABLE EXPLOSIVE GRANULAR MIXTURE | PUMPABLE EMULSION |
|---|---|---|
| Density of the explosive mixture ($cm^3$) | 1.14 | 1.20 |
| Sensitive to the Detonator No 8 | No | No |
| Sensitive to a bait of Dynamite, Emulsion and Booster HDP3 (150 g) | Yes | Yes |
| Speed of detonation (m/s) | 5515 | 4800 |
| Critical detonation diameter (Ø) | 32 mm | 45 mm |
| Lifetime (months) | 3 | 3 |
| Breaking power (mm) | 75 | 55 |
| Gas volume (L/kg) | 1280 | 980 |
| Energy (kcal/kg) | 805 | 690 |

In Table 2, it is possible to verify that the speed of the pumpable explosive granular mixture according to the embodiments of the present invention present a higher detonation speed compared to a conventional pumpable emulsion. In addition, it can be observed that the volume of the gases also increases significantly in the case of the explosive mixture according to the embodiments of the present invention as well as the energy. Therefore, it is well known in the explosives art that the explosive mixture of the invention have improved properties thanks to its composition.

The invention claimed is:

1. An explosive pumpable granular composition consisting of:

a) a matrix emulsion, which in turn comprises:

An oxidizing phase consisting of:

i. Ammonium nitrate with technical or fertilizer grade in a proportion of 60% to 80% on weight with respect to the total weight of the oxidizing solution;

ii. Sodium nitrate from 1% to 20% on weight relative to the total weight of the oxidizing solution;

iii. Urea from 0.1% to 8% on weight with respect to the total weight of the oxidizing solution;

iv. Thiourea from 0.1% to 2% on weight with respect to the total weight of the oxidizing solution;

v. Water from 5% to 20% on weight with respect to the total weight of the oxidizing solution;

vi. Acetic acid or sulfamic acid from 0.1 to 2% on weight with respect to the total weight of the oxidizing solution;

A combustible phase consisting of:

vii. Surfactants of polymeric nature from 1% to 35% on weight with respect to the total weight of the combustible solution;

viii. Nonionic surfactants of from 1% to 35% on weight relative to the total weight of the combustible solution;

ix. A hydrocarbon including petroleum, biodiesel or mixtures thereof from 1% to 80% on weight with respect to the total weight of the combustible solution;

x. A mineral oil of paraffinic or naphthenic nature from 1% to 70% wherein the proportion of the oxidizing solution is from 90% to 95% and the combustible solution is from 5% to 10% to form the matrix emulsion; and b) technical or fertilizer grade ammonium nitrate prills in a ratio from 5% to 50% on weight with respect to the total weight of the total density mixture from 0.85 g/cm3 to 0.99 g/cm3.

2. The composition according to claim 1, wherein in the combustible stage of (vii) surfactants of nonionic nature are selected from the group comprising Sorbitan Monooleate (SMO) and a surfactant of polymeric nature selected from the group comprising Polyisobutylene Succinic Anhydride (PIBSA) or Polyisobutylene lactate anhydride and mixtures thereof.

3. The composition according to claim 2, wherein the combustible stage of (vii), the surfactant for the matrix of the pumpable explosive composition is a mixture of PIBSA and SMO in a proportion of 10% to 90% of PIBSA with respect to the SMO.

4. The composition according to claim 1, wherein the pumpable explosive mixture is sensitized with 0.1% to 3% of a plastic microsphere based on copolymers of isobutane and isopentane or silica (glass).

5. The composition according to claim 1, wherein the explosive mixture is sensitized by chemical gasification with a solution of sodium nitrite.

6. The composition according to claim 1, wherein, the composition comprises a) a matrix emulsion in the proportion of 50% to 95% and b) 5% to 50% of high density ammonium nitrate prills.

7. The composition according to claim 1, wherein the composition is in a pumpable unit for bores from 32 mm to 65 mm or in a pumpable unit of pneumatic, electric, electro-pneumatic or hydraulic drive in underground mining.

8. The composition according to claim 1, wherein the explosive pumpable mixture is started with a 1"×8" (25.4 mm×203.2 mm) Dynamite or emulsion cartridge.

9. The composition according to claim 1, wherein in step vi. of the oxidizing phase, the acid is the sulfamic acid.

10. An explosive pumpable granular composition consisting of:

a) a matrix emulsion, which in turn consist:

An oxidizing phase consisting of:

i. Ammonium nitrate with technical or fertilizer grade in a proportion of 60% to 80% on weight with respect to the total weight of the oxidizing solution;

ii. Sodium nitrate from 5% to 7% on weight relative to the total weight of the oxidizing solution;

iii. Urea from 1% to 3% on weight with respect to the total weight of the oxidizing solution;

iv. Thiourea from 0.1% to 2% on weight with respect to the total weight of the oxidizing solution;

v. Water from 5% to 20% on weight with respect to the total weight of the oxidizing solution;

vi. Acetic acid or sulfamic acid from 0.1 to 2% on weight with respect to the total weight of the oxidizing solution;

A combustible phase consisting of:

vii. Surfactants of polymeric nature from 1% to 35% on weight with respect to the total weight of the combustible solution;

viii. Nonionic surfactants of from 1% to 35% on weight relative to the total weight of the combustible solution;

ix. A hydrocarbon including petroleum, biodiesel or mixtures thereof from 1% to 80% on weight with respect to the total weight of the combustible solution;

x. A mineral oil of paraffinic or naphthenic nature from 1% to 70% wherein the proportion of the oxidizing solution is from 90% to 95% and the combustible solution is from 5% to 10% to form the matrix emulsion; and b) technical or fertilizer grade ammonium nitrate prills in a ratio from 5% to 50% on weight with respect to the total weight of the total density mixture from 0.85 g/cm3 to 0.99 g/cm3.

11. An explosive pumpable granular composition consisting of:

a) a matrix emulsion, which in turn consists:

An oxidizing phase consisting of:

i. Ammonium nitrate with technical or fertilizer grade in a proportion of 60% to 80% on weight with respect to the total weight of the oxidizing solution;

ii. Sodium nitrate from 5% to 7% on weight relative to the total weight of the oxidizing solution;

iii. Urea from 1% to 3% on weight with respect to the total weight of the oxidizing solution;

iv. Thiourea from 0.1% to 2% on weight with respect to the total weight of the oxidizing solution;

v. Water from 5% to 20% on weight with respect to the total weight of the oxidizing solution;

vi. Acetic acid or sulfamic acid from 0.1 to 2% on weight with respect to the total weight of the oxidizing solution;

A combustible phase consisting of:

vii. Surfactants of polymeric nature from 1% to 35% on weight with respect to the total weight of the combustible solution, wherein the surfactants of polymeric nature include Polyisobuten succinic anhydride (PIBSA), polyisobuten lactate anhydride and mixtures thereof;

viii. Nonionic surfactants of from 1% to 35% on weight relative to the total weight of the combustible solution wherein the nonionic surfactants include Sorbitan Monoleate (SMO);

ix. A hydrocarbon including petroleum, biodiesel or mixtures thereof from 1% to 80% on weight with respect to the total weight of the combustible solution;

x. A mineral oil of paraffinic or naphthenic nature from 1% to 70% wherein the proportion of the oxidizing solution is from 90% to 95% and the combustible solution is from 5% to 10% to form the matrix emulsion; and b) technical or fertilizer grade ammonium nitrate prills in a ratio from 5% to 50% on weight with respect to the total weight of the total density mixture from 0.85 g/cm3 to 0.99 g/cm3.

* * * * *